United States Patent [19]

Aaron

[11] 4,051,854

[45] Oct. 4, 1977

[54] DIAPER PANTIES FOR BABIES

[75] Inventor: Gabrielle Leonie Aaron, Paris, France

[73] Assignee: Anciens Etablissements Rene Aaron, Paris, France

[21] Appl. No.: 650,624

[22] Filed: Jan. 20, 1976

[30] Foreign Application Priority Data

Jan. 24, 1975 France ..... 75.02209

[51] Int. Cl.[2] ..... A61F 13/16

[52] U.S. Cl. ..... 128/284; 128/DIG. 15; 128/288

[58] Field of Search ..... 128/284, 287, 165, 169, 128/346, 290 R, 290 H, 286, 288, DIG. 15

[56] References Cited

U.S. PATENT DOCUMENTS

| | | | |
|---|---|---|---|
| 2,444,973 | 7/1948 | Best | 128/287 |
| 2,828,745 | 4/1958 | Deutz | 128/287 |
| 3,081,772 | 3/1963 | Brooks et al. | 128/287 |
| 3,110,312 | 11/1963 | Wirth | 128/287 |
| 3,155,096 | 11/1964 | Outwin | 128/346 |
| 3,480,012 | 11/1969 | Smithers et al. | 128/165 |
| 3,504,672 | 4/1970 | Moon | 128/169 |
| 3,538,914 | 11/1970 | Meyers | 128/165 |
| 3,554,195 | 1/1971 | Murdoch | 128/284 |
| 3,563,242 | 2/1971 | Hedstrom | 128/287 |
| 3,618,608 | 11/1971 | Brink | 128/287 |

*Primary Examiner*—Aldrich F. Medbery
*Attorney, Agent, or Firm*—Darby & Darby

[57] ABSTRACT

A panty for babies and the like having an outer surface of a nappy material such as raised nylon. The panty includes a center flap and two ear flaps and at least one member having fastening means thereon in the form of a multiplicity of hooks engaging the nappy material to hold the ear flaps to the center flap. A waterproof liner also can be provided on the inner surface of the panty and a piece of water permeable fabric can be placed thereon to form a pocket adapted to hold a piece of moisture absorbent material.

12 Claims, 6 Drawing Figures

DIAPER PANTIES FOR BABIES

The present invention concerns diaper panties for babies, which comprise, as known, a central flap that goes between the legs and two side flaps, so-called ear flaps.

For swaddling a baby with this type of diaper panties the central flap is placed between the legs of the baby and on the belly, then the two ear flaps are fastened one after the other on the central flap by means of buttons or snap fasteners.

In addition to the inconveniences inherent in all systems using buttons or snap fasteners which get lost, rust, break or damage the washing machine, this arrangement has the additional inconvenience that it requires a selection of several sizes to correspond to the size of the baby.

On the other hand it is known to use two flexible bands to ensure the fastening of the two pieces of the garment on each other, each sewn on one of the garment pieces, one band consisting of a plurality of small hooks and the other of a plurality of rings, these two bands interlocking when they are applied on each other. However, the use of this type of closure for diaper panties does not eliminate the necessity of using a number of sizes and does not bring a solution to the problems of manufacturing price and cost price, since two pieces must be sewn for each fastening; the piece with the hooks and the piece with the rings, usually called astrakhan.

The diaper panties according to the preferred embodiments of the present invention have three flaps of raised nylon or other similar material and comprise at least one piece with hooks which can be engaged on the raised nylon at any point desired by the user.

Figure 1:
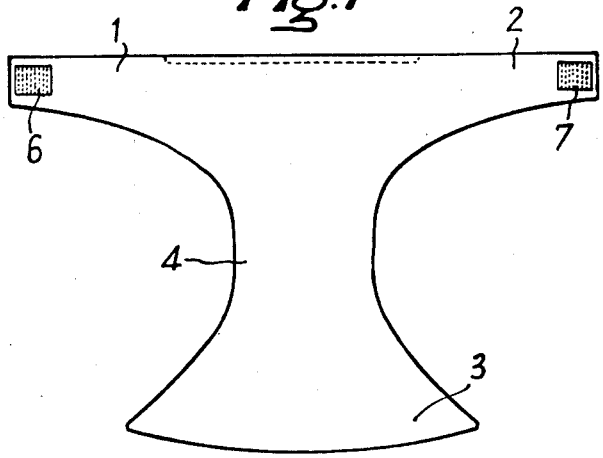
Figure 2:
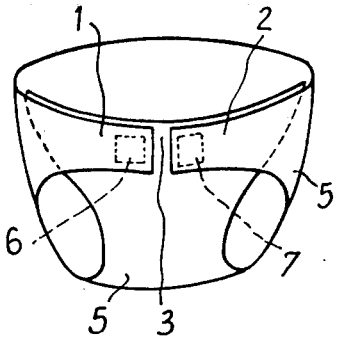
Figure 3:
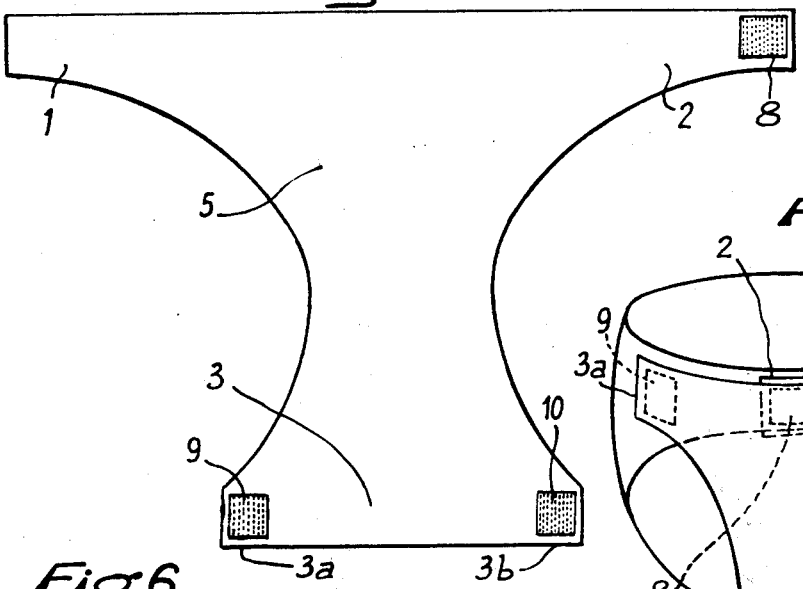

By way of a non-limiting example and in order to facilitate the understanding of the invention, the attached drawing show in:

FIG. 1 a plan view of the diaper panties according to the invention;

FIG. 2 a view of the diaper panties according to FIG. 1 with the three flaps in place FIG. 3 a plan view of the variant of the embodiment of FIG. 1

Figure 4:
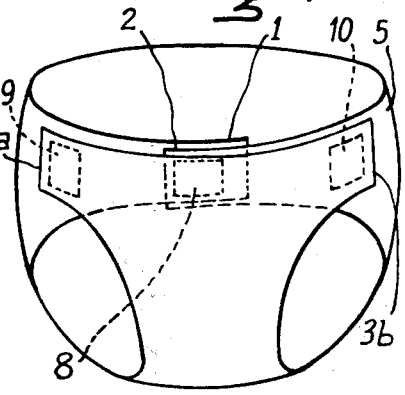

FIG. 4 a view of the diaper panties of FIG. 3 with the three flaps in place

Figure 5:
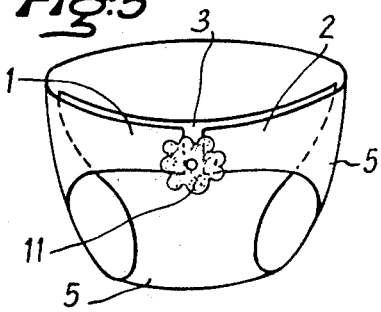

FIG. 5 a view of a variant of the embodiment of FIGS. 1 and 2

Figure 6:
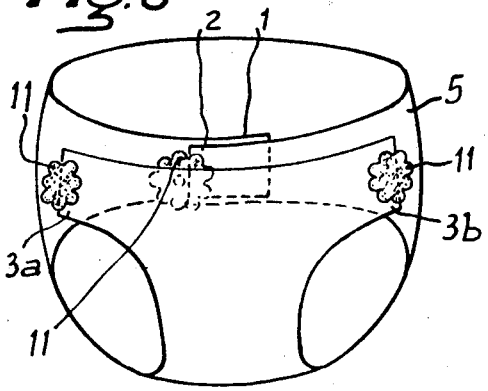

FIG. 6 a view of a variant of the embodiment of FIGS. 3 and 4.

Referring to FIG. 1, we see that the diaper panties comprise two ear flaps 1 and 3 and a center flap 3.

The inner surface 4 of the diaper panties visible in FIG. 1 is made of a suitable waterproof material; the other surface 5, however, which is not visible in FIG. 1 but can be seen in FIG. 2 at 5, is made of raised (e.g. brushed) nylon or any other raised cloth of polyamide fibers.

As shown in FIG. 1, the two ear flaps 1 and 2 have at their ends on the inner surface small pieces of a special material provided with small hooks.

Referring to FIG. 2, we see that in order to put these diaper panties in place the center flap 3 is placed on the belly of the baby, then ear flap 1 is placed on center flap 3, the piece of fabric with multiple hooks 6 engaging the outer surface 5 of flap 3 at any desired point; the same is done with ear flap 2 and its piece of material 7 with hooks.

According to a variant of the embodiment represented in FIG. 5, the ear flaps 1 and 2 do not comprise fabric pieces with multiple hooks, but are sufficiently long to abut on or close to each other. The three flaps are then put in place and a detachable piece 11 of fabric with multiple hooks is pressed on the zone or the two ends of the joining ear flaps. The detachable piece 11 engages the raised nylon of which the outer surface of the three flaps 1, 2 and 3 is made, thus making them one piece.

FIGS. 3 and 4 show a variant of the embodiment of FIG. 1 which permits a better fastening of the center flap and a better fit of the diaper panties. Referring to these figures we see that only one of the two ear flaps has a fabric piece with multiple hooks 8, while the center flap 3 itself has two ear flaps 3*a* and 3*b* provided respectively at their ends with fabric pieces 9 and 10 with multiple hooks.

For putting on diaper panties, flap 1 is first placed laterally on the belly of the baby and ear flap 2 is placed on it, the fabric piece with multiple hooks engaging the outer surface 5 of ear flap 1 at any desired point. Flap 3 is then placed between the legs of the baby, the two ear flaps 3*a* and 3*b* of flap 3 are placed against the hips of the baby, and the pieces 9 and 10 engage the outer surface 5 of the sides of the panties.

According to a variant of the embodiment represented in FIG. 6, the diaper panties contain no fabric piece with hooks, such as 8, 9, and 10, but the various elements are joined, similar as in FIG. 5, by means of detachable pieces of fabric with multiple hooks 11 placed on the lines where the flaps meet. Thus a piece 11 can be placed overlapping on the junction line of the ear flaps 1 and 2, another overlapping of the junction line between the end of ear flap 3*a* and the surface 5 of the hip of the panties, and another at ear flap 3*b*.

In this case, as in the case of the variant of FIGS. 1 and 2, shown in FIGS. 4 and 5, these detachable pieces 11 are preferably so cut that they have a decorative form, for example, the form of a flower, animal, butterfly etc.

The different arrangements described above have several advantages: they permit the elimination to the buttons or snap fasteners. They also permit the use of only three sizes of diaper panties instead of the five or six presently used, since they can be fastened at any desired point. This means considerable savings for the manufacturer, for the seller and for the user. They also permit a better fit of the panties around the leg of the baby, which eliminates the causes of irritation and provides better protection obtained by the diaper panties. They also make it facilitate greatly the application of the diaper panties.

Moreover, for the washing machine it suffices to turn over the panties and to fasten the pieces, such as 6, 7, 8, 9 or 10 on any point of the surface 5 to prevent these pieces from getting caught in other pieces, like undershirts or stockings. The washing present no difficulties, since there are no buttons etc. that can be detached and block or damage the mechanism of the washing machine.

According to any of FIGS. 1 to 6, the diaper panties can be an outer cover of raised nylon as which the pieces of raised nylon are engaged, this cover being lined with a sheet of waterproof plastic, which can consist of a suitable plastic such as polyvinyl chloride, and on the other hand with a permeable fabric which is soft in contact with the skin. A second lining is sewn or poasibly hot-sealed over its entire circumference on the outer cover and on the waterproof lining, except at the top, between the two ear flaps 1 and 2, as indicated at 12, to constitute a pocket having an opening into which an absorbent material of cotton or cellulose is placed. This opening can also be made on flap 3.

It is important for practical reasons that the permeable fabric in question does not permit the pieces with multiple hooks to be hooked, which would make handling of the diaper panties very inconvenient.

In this case it is preferable if the fabric is finemeshed, the size of the meshes being smaller than the dimensions of the hooks, and if the thread of which the fabric consists is as tight as possible; a jersey of Rhovyl thread can be used with advantage for this purpose.

Since the three layers of the diaper panties, namely the outer cover, the waterproof lining, and the fabric constituting the pocket for the absorbent material, as well as the fabric with multiple hooks are made of synthetic material, it is possible to eliminate any sewing and to obtain the diaper panties in a single operating by hot-sealing.

According to a variant of the embodiment the waterproof lining can be eliminated by making the outer cover waterproof on its inner surface.

What is claimed is:

1. A diaper panty of the body comprising a piece of fabric material formed with a center flap having a first portion to be placed between the legs and a second portion at each end thereof to be turned upwardly around the body, an ear flap extending from each side of one of said portions of said center flap to be folded around the body to accommodate the body size and to be adjacent to said other second portion of said center flap, the entire outer surface of said piece of material having a raised fiber surface, and at least one fabric fastening member having fabric fastening means thereon complementary to the raised fiber surface of said piece of material and for direct attachment and fastening thereto to hold the ear flaps in a fixed position with respect to the center flap.

2. Diaper panty as in claim 1 wherein said fastening means on said member comprises a plurality of hook elements which lock with the fibers.

3. Diaper panty as in claim 1 wherein a said member with fastening means thereon is fully detachable from the panty and overlaps the junction of at least one of said earl flaps and said other second portion of said center flap.

4. Diaper panty as in claim 3 wherein a said detachable piece has a decorative surface form.

5. Diaper panty as in claim 3 wherein said fastening means on said member comprises a plurality of hook elements which lock with the fibers.

6. Diaper panty as in claim 3 wherein said ear flaps are folded over said other second portion of said center flap and there is a single said member with fastening means thereon which fastens the two ear flaps together forming a belt under which the said other second portion of the center flap is secured.

7. Diaper panty as in claim 1 wherein a said member with fastening means thereon is secured to the inner surface of each of said ear flaps, said ear flaps being fastened to said other second portion of said center flap.

8. Diaper panty as in claim 7 wherein said fastening means on said member comprises a plurality of hook elements which lock with the fibers.

9. Diaper panties as in claim 1 wherein a respective first member with fastening means thereon is secured to the inner surface of each side of the other second portion of said center flap and a second member with fastening means thereon is secured to the inner surface of one of said ear flaps, said ear flaps being fastened together by said second member and said other second portion overlying said ear flaps and being secured to the piece of fabric material by said first members.

10. Diaper panty as in claim 9 wherein said fastening means on said member comprises a plurality of hook elements which lock with the fibers.

11. Diaper panty as in claim 1 further comprising a water-resistant liner on the inner surface of the panties, an inner member of water permeable material on the inner surface of said liner forming a pocket adapted to receive absorbent material.

12. Diaper panty as in claim 1 wherein said ear flaps of said one second portion are folded under said other second portion and there is a first fully detachable member with fastening means thereon for holding said ear flaps together, and second and third fully detachable member with fastening means thereon to hold each side of the other second portion to said piece of material.

* * * * *